US005938041A

United States Patent [19]

Stencel et al.

[11] Patent Number: 5,938,041

[45] **Date of Patent: *Aug. 17, 1999**

[54] APPARATUS AND METHOD FOR TRIBOELECTROSTATIC SEPARATION

[75] Inventors: John M. Stencel, Versailles; John L. Schaefer, Lexington; Heng Ban, Lexington; James K. Neathery, Lexington, all of Ky.

[73] Assignee: University of Kentucky Research Foundation, Lexington, Ky.

[ * ] Notice: This patent issued on a continued prosecution application filed under 37 CFR 1.53(d), and is subject to the twenty year patent term provisions of 35 U.S.C. 154(a)(2).

[21] Appl. No.: 08/726,255

[22] Filed: Oct. 4, 1996

[51] Int. Cl.[6] ..... B03C 7/12

[52] U.S. Cl. ..... 209/127.4; 209/127.1

[58] Field of Search ..... 209/127.1, 127.4, 209/128, 129, 130, 131, 906; 406/46, 47, 48, 193

[56] References Cited

U.S. PATENT DOCUMENTS

| | | | |
|---|---|---|---|
| 2,479,615 | 8/1949 | Guizzetti | 209/127.4 |
| 3,385,435 | 5/1968 | Lawver et al. | 209/129 |
| 3,493,109 | 2/1970 | Carta et al. | 209/127.1 |
| 3,941,685 | 3/1976 | Singewald et al. | 209/9 |
| 4,213,766 | 7/1980 | Wyatt | 55/2 |
| 4,475,922 | 10/1984 | Rich | 44/1 C |
| 4,481,017 | 11/1984 | Furlong | 55/12 |
| 4,482,351 | 11/1984 | Kitazawa et al. | 44/1 R |
| 4,530,291 | 7/1985 | Wysk | 110/342 |
| 4,797,201 | 1/1989 | Kuppers et al. | 209/127.4 |
| 5,149,339 | 9/1992 | Collins, Jr. | 55/6 |
| 5,193,942 | 3/1993 | Berry et al. | 406/47 |
| 5,224,604 | 7/1993 | Duczmal et al. | 209/12 |
| 5,251,762 | 10/1993 | Taylor et al. | 209/128 |
| 5,275,631 | 1/1994 | Brown et al. | 44/631 |
| 5,288,305 | 2/1994 | Gellert et al. | 95/57 |
| 5,332,562 | 7/1994 | Kersey et al. | 423/210 |
| 5,513,755 | 5/1996 | Heavilon et al. | 209/2 |
| 5,556,443 | 9/1996 | Alexander | 209/129 |

FOREIGN PATENT DOCUMENTS

| | | | |
|---|---|---|---|
| 691165 | 5/1940 | Germany | 209/127 |

*Primary Examiner*—Boris Milef
*Assistant Examiner*—Patrick Mackey
*Attorney, Agent, or Firm*—King and Schickli

[57] ABSTRACT

A triboelectrostatic separation apparatus includes a separator with an inlet, a separation chamber, first and second electrodes, a variable voltage source for applying respective positive and negative voltage potentials to the electrodes, a pair of separated particle outlets and a curtain gas flow generation system. The curtain gas flow generation system includes a source of curtain gas at positive pressure, a metering valve for matching curtain gas flow velocity to particle flow velocity and flow straighteners for eliminating eddy currents. A method for separating electrostatically charged particles is also described.

9 Claims, 4 Drawing Sheets

10
12
14
16
PRESSURIZED DRIVING FLUID SOURCE
18
20
M VALVE 42
POSITIVE PRESSURE CURTAIN GAS SOURCE
40
44
24
46
48
22
26
38
34
36
64
FAN
FAN
FAN
64
64
60
60
60
62
62
62

40"
80"
20"
8"
4"
4"
24"
2tph
200pph
20pph

APPARATUS AND METHOD FOR TRIBOELECTROSTATIC SEPARATION

TECHNICAL FIELD

The present invention relates generally to the field of material separation and, more particularly, to an apparatus and method for electrostatically separating two species of particles present in a raw feedstock.

BACKGROUND OF THE INVENTION

The concept of electrostatic separation is well known in the art. For example, in U.S. Pat. No. 3,493,109 to Carta et al. ore particles are charged by triboelectricity. The Carta et al. separator includes a tangentially arranged inlet duct for feeding ore particles into a cyclone. The inner surface of the cyclone is coated with special materials. The dielectric constant or surface work function of these materials is intermediate that of the two species of particles to be separated. More particularly, physical contact and friction between particles themselves and the coated inner surface of the separator produces charges of opposite polarity on the two species of particles to be separated. The charged particles are then delivered from the cyclone to a separation chamber including opposing electrodes of opposite polarity. An electric field results which tends to draw the charged particles apart thereby completing the separation process. Other examples of the electrostatic separation process are disclosed in, for example, U.S. Pat. No. 4,482,351 to Kitazawa et al.; 3,941,685 to Singewald et al.; 5,275,631 to Brown et al.; 5,332,562 to Kersey et al. and 5,224,604 to Duczmal et al. While all of these known apparatus and processes provide for separation of selected particles, it should be appreciated that improvements in separation efficiency are still possible. More specifically, prior art apparatus and methods for electrostatic separation of particles generally suffer substantial inefficiencies resulting from turbulent flow conditions that disturb the deflection path of the charged particles as they are drawn in the electric field to the oppositely charged plates or electrodes. Further, prior art approaches fail to provide any effective form of cleaning action to remove or strip particles from the plates or electrodes once they adhere thereto as a consequence of electrostatic forces. Accordingly, a need is identified for an improved apparatus and method.

SUMMARY OF THE INVENTION

Accordingly, it is a primary object of the present invention to provide an improved apparatus and method for triboelectrostatic separation of two species of particles present in a raw feedstock where those two particles species have differing dielectric constants or work functions.

Another object of the present invention is to provide an apparatus and method for triboelectrostatic separation of particles that effectively optimizes the purity of the desired product by substantially eliminating turbulence and eddy currents and thereby minimizing mixing of the particles. As a result, those particles being electrostatically separated in the electric field follow a smooth, straight path with any deflection from particle-to-particle contact being minimized. Further, once separated, the particles follow a direct trajectory to the discharge outlet from which they may be collected.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved triboelectrostatic separation apparatus is provided. The apparatus includes a separation chamber having an inlet for receiving electrically charged particles to be separated. The separation chamber also includes a first electrode for attracting negatively charged particles and a second electrode for attaching positively charged particles. Additionally, the separation chamber includes a first outlet for discharging negatively charged particles electrostatically drawn towards the first electrode as well as a second outlet for discharging positively charged particles electrostatically drawn toward the second electrode.

The apparatus also includes a variable voltage source. The variable voltage source applies a positive voltage potential to the first electrode and a negative voltage potential to a second electrode so as to establish an electric field for the electrostatic separation of particles within the separation chamber in the manner described.

Further, the apparatus includes a means for generating a flow of curtain gas devoid of particles along the first and second electrodes. Advantageously, the flow of curtain gas functions to direct or carry the charged particles electrostatically drawn towards the first and second electrodes to the respective first and second outlets for recovery. Accordingly, any remixing of the electrostatically separated particles is minimized and particle separation efficiency and the resulting product purity is, thereby, significantly enhanced.

Still further, the apparatus also includes a pneumatic eductor. More specifically, the pneumatic eductor receives the raw feed stock of the particles to be separated. These particles are delivered to the eductor and accelerated by a driving fluid such as air or other dry, gaseous medium. The driving fluid conveys the particles through a feed line constructed from or lined with a dielectric material having a dielectric constant or work function intermediate to the two species of particles desired to be separated. As a result of particle-particle contact and particle-feed line wall contact, the particles are electrically charged prior to delivery to the inlet of the separation chamber.

More specifically describing the invention, the curtain gas generating means referenced above includes a source of curtain gas at positive pressure and a metering valve for matching the curtain gas flow velocity with the driving fluid and electrostatically charged particle flow velocity. Advantageously, this matching of the velocities insures that eddy currents and turbulence, particularly along the curtain gas and driving fluid interface are minimized. Accordingly, particles flow through the apparatus smoothly and, therefore, any deflection of particles being electrostatically drawn along a path of separation is minimized. This advantageously serves to enhance separation efficiency. In order to further minimize turbulence and eddy currents, the inlet of the separation chamber preferably includes a diffuser having flow straightener vanes. These vanes, in the form of elongated walls extending longitudinally along the flow path through the inlet tend to eliminate any swirling eddy currents and promote curtain gas flow in a straight line through the separation chamber.

In accordance with still another aspect of the present invention, the apparatus includes a means for recovering the electrostatically charged particles from the driving fluid following separation. Preferably, the particles are effectively filtered from the driving fluid and collected for subsequent use or processing while the driving fluid (now substantially devoid of particles) is recycled and/or exhausted into the environment. Of course, in order to further enhance system flow through the apparatus, the apparatus may also include induced draft fans downstream from the first and second outlets. These fans function to produce a negative pressure to draw particles through the separation chamber and the recovering means that filters the particles from the driving fluid.

In accordance with yet another aspect of the present invention, a method is provided for separating electrostatically charged particles. The method comprises the step of delivering electrostatically charged particles in a driving fluid to a separation chamber. As described above, that separation chamber includes a positive electrode for attracting negatively charged particles and a negative electrode for attracting positively charged particles.

This step is followed by the generating of a flow of curtain gas devoid of particles along the electrodes. This curtain gas functions to direct or carry the positively negatively charged particles to separate recovery outlets.

As described in further detail below, the method also includes the steps of matching the flow velocity of the curtain gas with the flow velocity of the driving fluid as well as the passing of the curtain gas past or through flow straighteners. Both of these steps function to eliminate eddy currents and turbulence so as to provide smooth, straight flow that effectively enhances particle separation efficiency.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
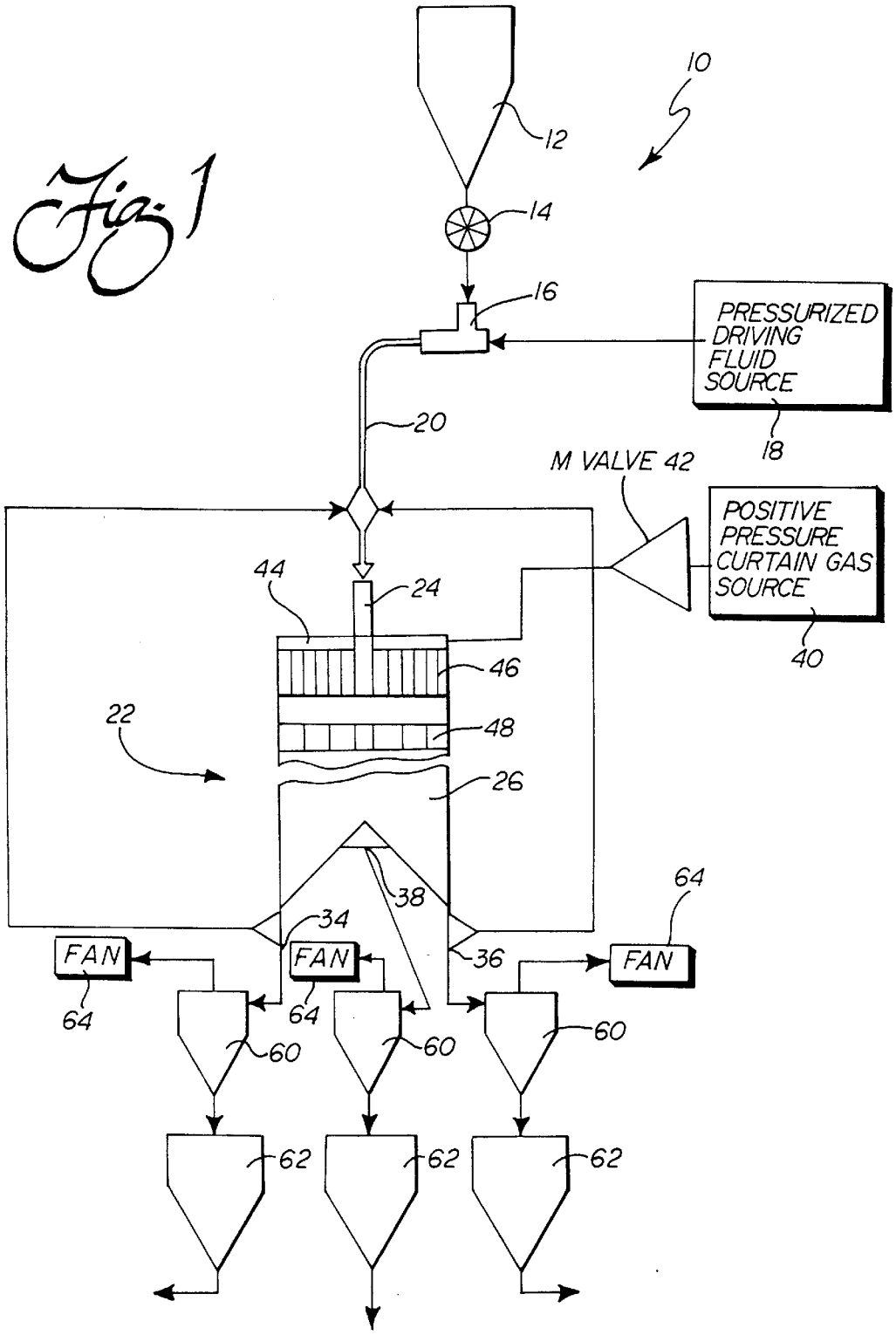
FIG. 1 is a schematical representation of a triboelectrostatic separation apparatus constructed in accordance with the teachings of the present invention.

Reference will now be made to FIG. 1 schematically showing the triboelectrostatic separation apparatus 10 of the present invention. Such an apparatus 10 may be utilized in a method of separating two species of particles present in a raw feedstock. For example, the apparatus 10 may be utilized in the separation and purification of the mineral matter or pyrite constituents from the carbon constituents in finely-ground or sized coal; ash constituents from carbon in coal combustion ash; specific minerals obtained from fine-sized mineral mixtures; heavy metal or radioactive components which are physically mixed in soils or other materials; and ceramics contained in mixtures of ceramics, metals or organic polymers. In all cases, the terms "fine sized" or "finely ground" refer to particles having physical diameters in the range of 500 $\mu$m to approximately 0 $\mu$m and preferably, a diameter smaller than 75 $\mu$m. It should be appreciate that the apparatus 10 is used for separating dry particles in contrast to wet particles or wet separation systems in which water or some other liquid with or without water is used to effect particle separation and purification.

As shown in FIG. 1, the raw feedstock including the particles to be separated is contained in a surge bin 12. The raw feedstock is fed from the surge bin 12 under the control of outlet valve 14 into the pneumatic eductor 16. Preferably, the control valve 14 is a star valve, volumetric feeder, mass weigh belt or other appropriate mass flow controller of a type known in the art.

As should be appreciated, the pneumatic eductor 16 is also operatively connected in fluid communication with a pressurized driving fluid source 18 such as a high pressure air pump. The driving fluid is preferably air although other gases such as nitrogen, helium, argon, carbon dioxide or combustion flue gas may be utilized at ambient temperature or even temperatures as high as 1000°C. As the raw material mixes with the driving fluid in the pneumatic eductor 16, the raw material is accelerated and conveyed by the driving fluid along the feed line 20. As shown, the feed line 20 communicates between the pneumatic eductor 16 and the inlet of the separator 22 defined by diffuser 24. The feed line 20 is constructed so as to include no or a minimal number of sharp (approximately 90°) bends. Further, the feed line 20 is constructed from or lined with a wear resistant dielectrical material having a dielectric constant or work function intermediate the two species of particles desired to be separated. The material may be chosen in order to selectively charge one of the species of particles to be separated while minimizing the charge of the other species or selectively charge both of the species to be separated with different polarities.

Generally, the material selected for the feed line 20 may be selected from a group consisting of metal including hardened steels and specialty alloys, ceramic, plastic and mixtures thereof. Specific materials may, for example, be selected from a group such as copper, stainless steel, polytetraflorethylene, polytetraethylene, polypropylene, silica, alumina, iron, cobalt, nickel, tungsten, molybdenum, titanium, aluminum, zirconium, iron oxide, iron (II) oxide, iron (III) oxide, cobalt (II) oxide, cobalt (III) oxide, nickel monoxide, tungsten dioxide, tungsten trioxide, tungsten pentoxide, molybdenum dioxide, molybdenum trioxide, molybdenum pentoxide, molybdenum sesquaoxide, titanium monoxide, titanium dioxide, titanium sesquaoxide, aluminum oxide, zirconium oxide, polyvinylchloride, polyurethane and mixtures thereof. Alloys of the listed metals may also be utilized and, of course, it should be appreciated that this list of materials is illustrative and not exhaustive.

The feed line 20 is sized to handle solid flow rates that are determined by the capacity of the apparatus 10. The solid/gas mass ratio in the feed line 20 is preferably 1/1 although values of this ratio between 10/1–1/1000 may be utilized. In addition, the velocity of the particle-mixture in the feed line 20 should be at least 10 m/s although velocities between 1–50 m/s may be employed. Higher velocities impart greater charging of the gas-entrained particles by tribocharging action in which particle-particle and particle-sidewall collisions are maximized. The flow in the feed line 20 is required to be turbulent with Reynolds number, $R_e$>2300 (where $R_e$=DV/v where D=particle diameter, V=fluid flow velocity, and v=kinetic viscosity of the fluid).

Figure 2A:
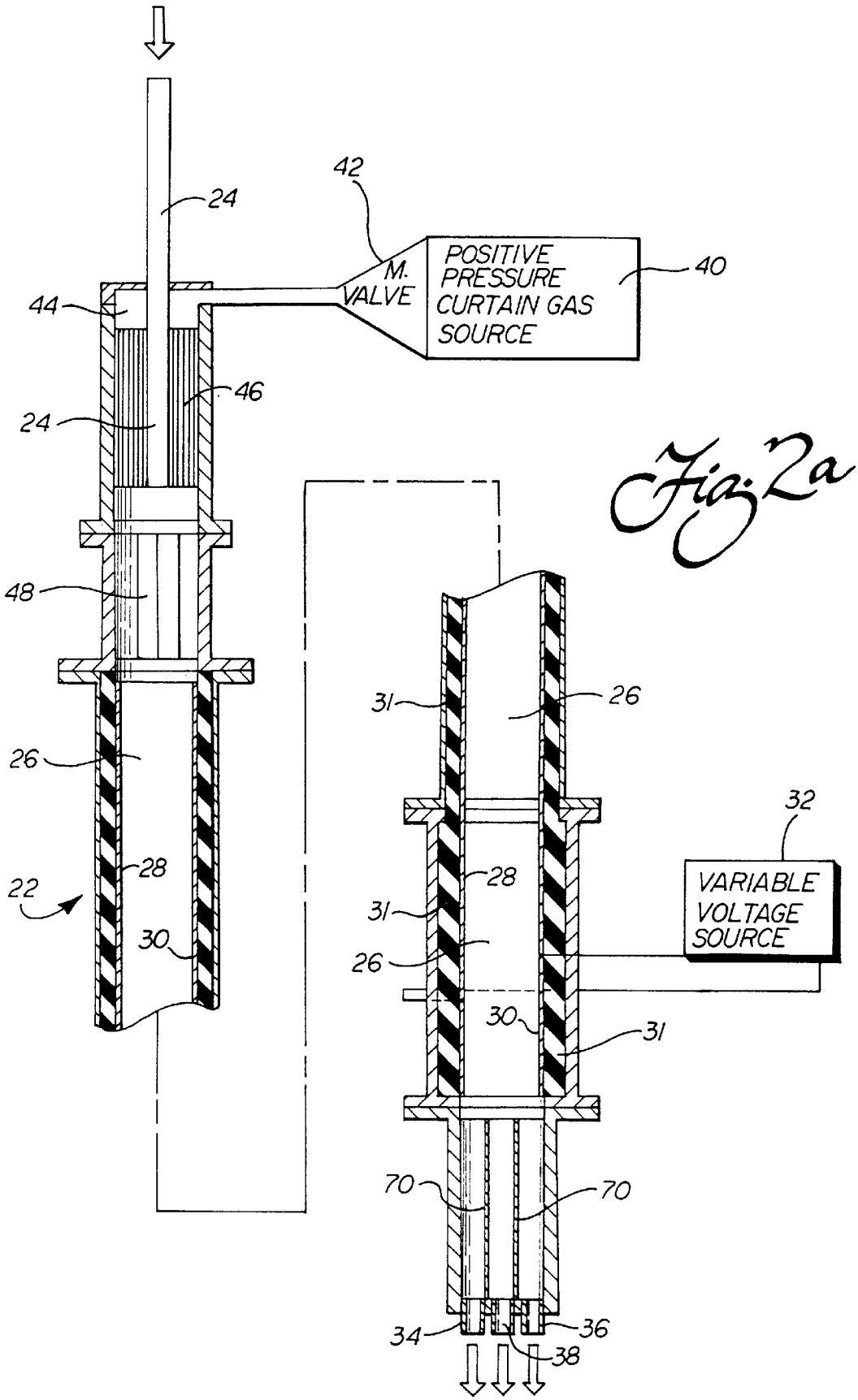
FIG. 2*a* is a detailed cross-sectional view of the separation chamber of the apparatus of the present invention.
Figure 2B:
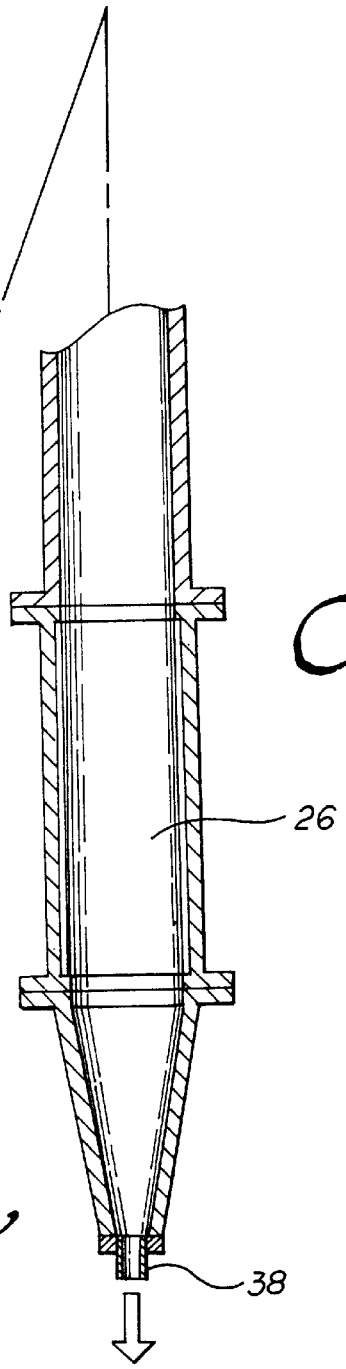
FIG. 2*b* is a cross-sectional view of the same separation chamber said cross-sectional view being in a plane perpendicular to the cross-sectional view shown in FIG. 2*a* and the plane of the two dimensional illustration of FIG. 1.

The separator 22 is best shown with reference to FIGS. 2*a* and 2*b*. The inlet of the separator 22 is defined by the diffuser 24. The diffuser 24 expands and controls the dimensional area through which the flow of the gas-particle mixture is passed entering the separator 22. The inlet side of the diffuser 24 receives the electrostatically charged particles entrained in the driving fluid from the feed line 20. The inlet side of the diffuser 24 is configured and sized to be identical to the configuration and size of the feed line 20. In the direction perpendicular to the plane of the drawing shown in FIG. 1 (see FIG. 32*b*), the outlet or discharge end of the diffuser 24 is configured and sized to match or nearly match the separation chamber 26. The increase in the width dimension of the diffuser 24 is preferably at an angular rate of near or less than 10° to a maximum value that is equal to the width of the separation chamber 26 in a direction perpendicular to the applied electric field. Of course, as the volume of the diffuser 24 increases towards the outlet end feeding the separation chamber 26, the velocity of the driving fluid and entrained electrostatically charged particles gradually falls.

The separation chamber 26 effectively defines the particle separation zone of the apparatus 10. Here positive and negative particles are acted upon by an applied electric field established across parallel plates or electrodes 28, 30 located on opposite sides of the chamber.

More specifically, in the present illustration the first electrode 28 is provided for attracting negatively charged particles while the second electrode 30 is provided for attracting positively charged particles. Accordingly, the first and second electrodes 28, 30 are connected to a variable voltage source 32 which applies a positive voltage potential to the first electrode 28 and a negative voltage to a second electrode 30. The distance between the first and second electrodes is between 2 and 40 inches and more preferably 4–10 inches. The height of each electrode 28, 30 is between 12–100 inches and more preferably 24–36 inches. The width of each electrode is between 2–120 inches and more preferably 4–40 inches. Each electrode 28, 30 is electrically insulated from the outer wall of the separator 22 by an insulating element 31.

As should further be appreciated from viewing FIGS. 1 and 2*a*, the separator includes a first outlet 34 longitudinally aligned with the first electrode 28 for discharging negatively charged particles electrostatically drawn toward the first electrode. Additionally, the separator 22 includes a second outlet 36 longitudinally aligned with the second electrode 30 for discharging positively charged particles electrostatically drawn toward the second electrode. Further, in certain embodiments, the separator 22 may include a third intermediate outlet 38 longitudinally aligned with the centerline of the separation chamber 26.

Figure 3A:
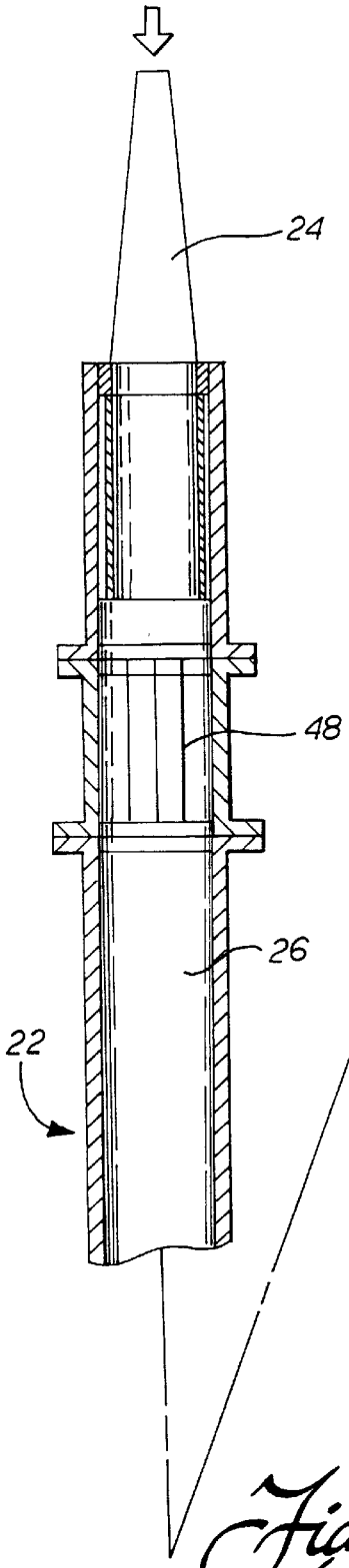
FIG. 3*a* is a schematical transverse cross-sectional view through the first flow straightener.

In accordance with an important aspect of the present invention, the apparatus 10 also includes a means for generating a flow of curtain gas devoid of particles along the first and second electrodes 28, 30. This curtain gas flow generating means includes a positive pressure curtain gas source 40 that is connected through a metering valve 42 to a curtain gas flow manifold 44 that is concentrically received about the diffuser 24. As should be appreciated, the flow manifold 44 includes a series of orifices (not shown) that direct the curtain gas flow into a first flow straightener 46 concentrically disposed about a discharge end of the diffuser 24. As best shown in the cross-sectional view of FIG. 3*a*, the flow straightener 46 comprises a grid-like structure that suppresses eddy currents and turbulence in the curtain gas being delivered through the manifold 44.

Next, the driving fluid flow with entrained charged particles and the curtain gas flow are delivered, respectively, into a first end of the separation chamber 26 from the diffuser 24 and flow straightener 46. As the two previously separate flows come into contact, any tendency to intermix is minimized. More specifically, the metering valve 42 is set to substantially match the flow velocity of the curtain gas flow with the flow velocity of the driving fluid and entrained particle flow exiting the diffuser 24. Further, a second flow straightener 48 is provided in the entry end of the separation chamber adjacent to the ends of the diffuser 24 and first flow straightener 46.

Figure 3B:
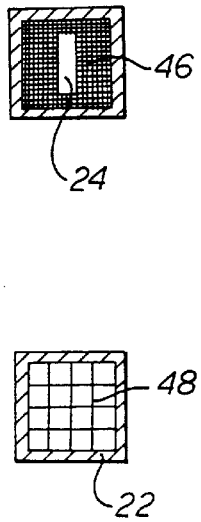
FIG. 3*b* is a schematical transverse cross sectional view thorough the second flow straightener.

As should be appreciated from viewing FIG. 3*b*, the second flow straightener 48 is also a grid like structure that suppresses eddy currents and turbulence in the driving fluid and entrained particle flow as well as the curtain gas flow. As a result, the two flows remain discrete and at this point the particles are concentrated at the center section of the separation chamber with particle free curtain gas flow directed over the electrodes 28, 30. Preferably, the aspect ratio of the first flow straighteners 46 is between 15–1 to 50–1 (aspect ratio =length/diameter). In contrast, the aspect ratio of the second flow straighteners 48 is preferably between 5–1 to 25–1.

As a result of the virtual elimination of turbulent flow conditions and the initial presentation of particle free curtain gas flow adjacent the electrodes 28, 30, the individual charged particles are freely drawn toward the electrode 28 or 30 of opposite polarity. In essence the deflection path of the particle under the influence of the electric field remains undisturbed. As a result, electrostatic particle separation efficiency is maximized. Further, it should be appreciated that the flow of the electrostatically separated particles from the vicinity of each electrode 28, 30 into the underlying outlet 34, 36 is directed by the curtain gas flow which moves straight toward the underlying outlet associated with each electrode (note action arrows A, B in FIG. 2*a*). As a result particles that have been electrostatically separated remain separated and do not remix. Again, this feature of the invention enhances particle separation efficiency.

As should further be appreciated from viewing FIG. 1, each of the first and second outlets 34, 36 is connected to a means 60 for recovering electrostatically charged particles from the driving fluid following separation. Preferably, each recovery means is an individual cyclonic separator 60 as schematically illustrated in drawing FIG. 1. It should be appreciated, however, that other appropriate particulate clean-up equipment may be utilized including, for example, bag filters. The recovered, separated particles are then stored in the hoppers 62 for subsequent use or processing. Induced draft fans 64 are operatively connected to the exit end of the apparatus 10. These induced draft fans 64 function to create a negative pressure in the apparatus 10 that helps draw the driving fluid and particles through the apparatus and then exhaust the driving fluid to atmosphere or to be recycled to the pressurized driving fluid source 18. The negative pressure established by the induced draft fans 64 in the separator 22 is between 1 to 50 inches water or 2.54 to 127 cm Hg.

The method of the present invention is easily understood with reference to the drawing figures and the above description of the apparatus 10. Once the particles to be separated are fed into the pneumatic eductor 16 through the valve 14, they are electrostatically charged by particle-particle and particle-sidewall contact in the feed line 20. Next, the particles are delivered in a driving fluid to the separation chamber 26 including the first electrode 28 with positive voltage potential for attracting negatively charged particles and the second electrode 30 with negative voltage potential for attracting the positively charged particles. Further, the method includes the step of generating a flow of curtain gas devoid of particles along the electrodes 28, 30. This curtain gas serves to direct the separated positively and negatively charged particles to the separate recovery outlets 34, 36.

Of course, as previously noted, a smooth regimen of particle-gas flow within the separator 22 is critical in order to insure efficient particle separation and purification. Smooth flow is accomplished, in part, by matching the flow velocity of the curtain gas with the flow velocity of the driving fluid leaving the diffuser 24. This substantially eliminates turbulent flow particularly along the interface of the driving fluid flow and curtain gas flow that would otherwise disturb the deflection path of the charged particles as they are electrostatically drawn toward the first and second electrodes 28, 30. Smooth flow is also accomplished in part by passing the curtain gas past/through the first flow straightener 46 and both of the driving fluid and curtain gas flow streams past/through the second flow straighter 48. This serves to eliminate eddy currents that might otherwise develop.

It should also be appreciated that this results in the curtain gas flow following a smooth, straight path along the longitudinal axis of the electrodes 28, 30. Thus, the curtain gas flow provides a cleaning action that sweeps the particles (that might otherwise adhere to the electrodes 28, 30 as a consequence of electrostatic forces) toward the corresponding outlets 34, 36. Advantageously, as a result of the smooth non turbulent flow, the particles are directed straight to the outlets 34, 26 and, therefore, do not remix near the center of the longitudinal axis of the separation chamber 22 above the third outlet 38. Accordingly, highly purified negatively charged particles are collected through the first outlet 36 while highly purified positively charged particles are collected at the second outlet 36 and substantially unseparated materials are collected at the third outlet 38. Of course, any or all of the particles and driving fluid passing through any of the outlets 34, 36, 38 may be recycled into the feed line 20 just above the diffuser 24 or at the pneumatic eductor 16 in an effort to enhance the separation process in a manner known in the art (see FIG. 1).

The amount-per-hour of materials that may be separated and purified utilizing the present apparatus 10 and method is dependent on the width on the separation zone. For example, using first and second electrodes 28, 30 that are separated by approximately 4 inches and are approximately 4 inches wide enables up to 20 lb/hr of materials to be separated. If the width of the electrodes 28, 30 is increased to 40 inches, up to 100 lb/hr of material may be separated and purified.

Figure 4:
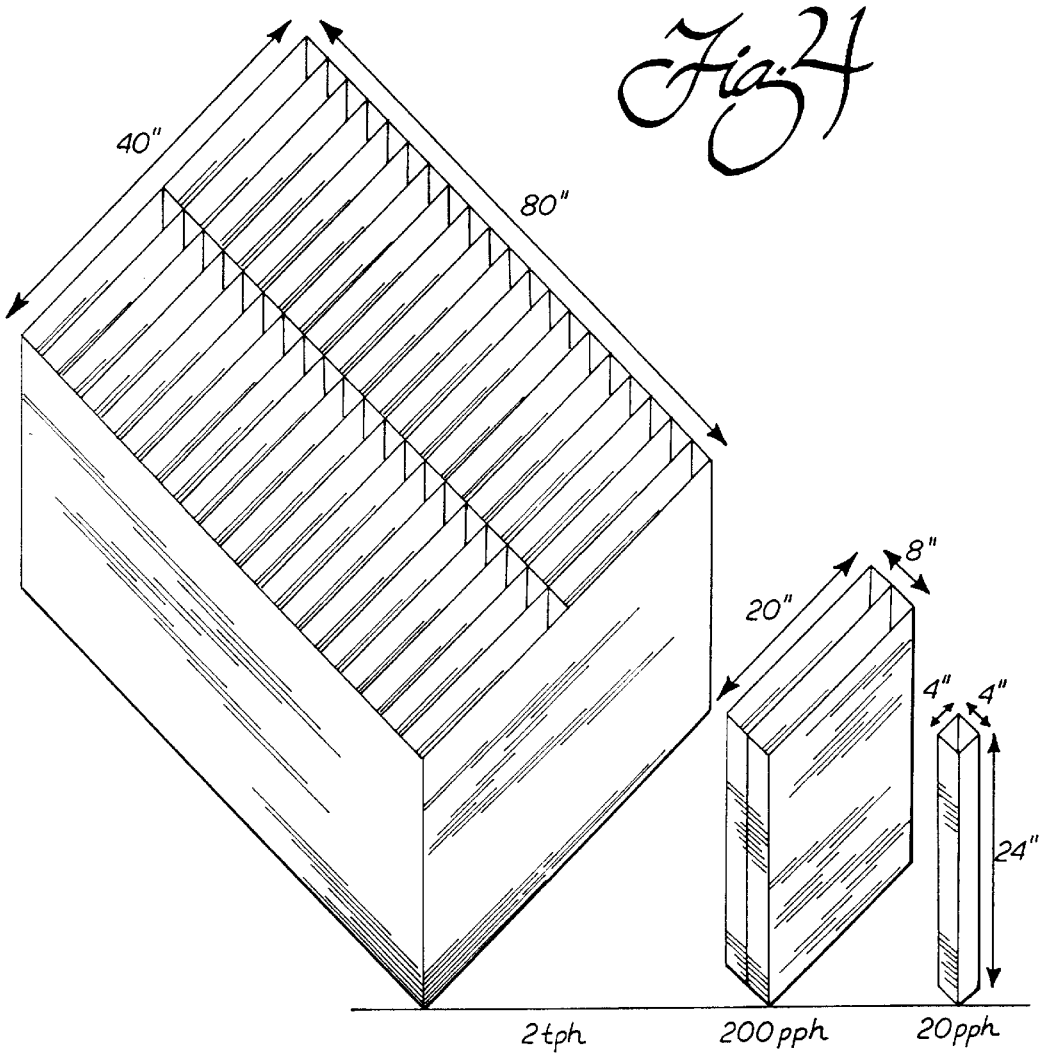
FIG. 4 shows a system of parallel apparatus of the present invention providing for enhanced material handling capacity.

In order to increase the throughput of the apparatus 10 to 200 lb/hr, all components must be increased to appropriate dimensions. These dimensions may be calculated utilizing well-known engineering principals. It should be recognized, however, that the apparatus 10 embodies a unique, modular design and an increase in throughput may be accommodated by stacking apparatus 10 of the type described in parallel. Thus, for example, as shown in FIG. 4, a system comprising a series of apparatus 10 allowing for feed rates of material at, for example, 200 lb/hr and 2 tons/hr may be provided.

As should be appreciated from the above, the control of the purity of the separated particles or products under smooth flow conditions may be accomplished by adjustment of separator dimensions and operating parameters. Specifically, the voltage across the electrodes 28, 30 may be adjusted in order to provide electric field strengths between 10–500 kV/m and more preferably 50–200 kV/m. The preferred values are less than that needed for corona discharge and electrical shorting. The optimum voltage is influenced by the extent of charge imparted to the particles.

At high charge values, that is greater than $10^{-5}$C/kg, a high electric field strength (>150 kV/m) causes particle trajectories which can approach the electrodes 28, 30 at incident angles near or greater than 45°. As a consequence of the high angle of impact, there is a high probability of charge reversal or particle disengagement from the electrodes 28, 30 at angles that re-entrain the particles into the exit port stream of improper polarity. Particle trajectories which result from the electric force on charged particles ($F_{charge}$=qE where q is the charge and E is the electric field strength) should be contained to incident angles less than 45° in order to avoid this potential problem.

The flow velocity of particles within the separation zone determines their residence time within the electric field. By slowing the velocity, a longer residence time is achieved. The opposite is, of course, accomplished by increasing the velocity. Preferably residence times are between 0.1–5.0 seconds. Of course, it is also possible to change the residence time within a separation zone by varying the length of the electrodes 28, 30.

The degree of tribocharging of the particles is also important. Specifically, particles that are highly charged with positive and negative polarities deflect toward the proper polarity plate electrodes with velocities greater than less fully charged particles. The amount of charge on the particles may be adjusted by changing the velocity of the particles in the feed line 20. Values of the charge required to generally provide best separation results are between $10^{-7}$–$10^{-4}$ C/kg, and preferably $10^{-5}$ C/kg.

In addition, the location of the partitions 70 leading to the individual discharge outlets 34, 36, 38 control the splitting of the separated particle products from the separator 22 and the amount of material exiting each outlet. For the triple outlet configuration shown in FIG. 2*a*, the partitions 70 divide the area of the separator equally into three sections. It, of course, is possible to decrease or expand these areas and/or change the number of outlets, thereby fine-tuning the purity of the particle products obtained at each outlet utilizing the present separation method.

Examples of product separation and purification for coal combustion fly ash are presented in Table 1 below.

| Feed | | Feed Rate | | % C | % C | % C |
|---|---|---|---|---|---|---|
| Ash ID | V(kV) | (lb/hr) | (Feed) | (Low C Exit) | | (High C Exit) |
| 1 | | 7.5 | 4.83 | 10.45 | 3.24 | 24.26 |
| 1 | | 10.0 | 4.79 | 10.45 | 3.87 | 23.54 |

-continued

| Feed Ash ID | V(kV) | Feed Rate (lb/hr) | (Feed) | % C (Low C Exit) | % C | % C (High C Exit) |
|---|---|---|---|---|---|---|
| 1 | | 12.5 | 1.87 | 10.45 | 4.12 | 20.04 |
| 1 | | 12.5 | 4.82 | 10.45 | 4.11 | 19.70 |
| 2 | | 10.0 | 4.09 | 11.68 | 2.26 | 32.62 |
| 2 | | 10.0 | 11.76 | 11.68 | 2.77 | 29.64 |
| 2 | | 10.0 | 16.32 | 11.68 | 3.09 | 28.60 |
| 2 | | 10.0 | 20.22 | 11.68 | 3.22 | 24.70 |
| 2 | | 15.0 | 4.92 | 12.07 | 2.34 | 34.39 |
| 3 | | 15.0 | 4.50 | 8.87 | 2.20 | 36.70 |
| 4 | | 10.0 | 4.79 | 9.94 | 3.87 | 23.54 |

These data show that the concentration of carbon in the ash-enriched streams is decreased by values of between approximately 60–80%. These data also show the extent to which carbon may be removed from combustion fly ash at different feed rates and voltages utilizing the apparatus and method of the present invention.

In summary, numerous benefits result from employing the concepts of the present invention. More specifically, as a result of the provision of a curtain gas flow longitudinally along the electrodes 28, 30, particles electrostatically drawn to the electrodes are swept smoothly toward the associated discharge outlets 34, 36 where they may be collected in high purities. Advantageously, by matching the velocity of the flow of curtain gas to the velocity of the driving fluid and particles leaving the diffuser 24 and entering the separation chamber 26, turbulence at the interface of the curtain gas flow and driving fluid is minimized. Further, the flow straighteners 46, 48 also function to suppress, minimize and virtually eliminate eddy currents that might otherwise disrupt particles being separated from their desired trajectories toward the electrodes 28, 30. As a result of this system, separation efficiency is enhanced and particle separation is optimized.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, the voltage potential of the electrodes may be reversed. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A triboelectrostatic separation apparatus, comprising:

a pneumatic eductor wherein particles to be separated are accelerated by a driving fluid:

a separator including an inlet for receiving said particles to be separated, a separation chamber, a first electrode for attracting negatively charged particles, a second electrode for attracting positively charged particles, a first outlet for discharging negatively charged particles electrostatically drawn toward said first electrode and a second outlet for discharging positively charged particles electrostatically drawn toward said second electrode;

a feed line providing fluid communication between said pneumatic eductor and said inlet to said separator said particles being triboelectrically charged in said feed line by promoting particle-particle and particle-sidewall contact prior to entering said separator;

a variable voltage source for applying a positive voltage potential to said first electrode and a negative voltage potential to said second electrode; and means for generating a flow of curtain gas initially devoid of particles along said first and second electrodes in said separation chamber, said flow of curtain gas carrying charged particles electrostatically drawn under the influence of an electric field along an undisturbed deflection path toward said first and second electrodes without remixing respectively to said first and second outlets for recovery.

2. The apparatus set forth in claim 1, wherein said generating means includes a source of curtain gas at positive pressure and a metering valve for matching curtain gas flow velocity with driving fluid and electrostatically charged particle flow velocity.

3. The apparatus as set forth in claim 2, wherein said inlet includes a diffuser having flow straighteners for substantially eliminating eddy currents.

4. The apparatus as set forth in claim 3, further including means for recovering electrostatically charged particles from said driving fluid following separation.

5. The apparatus as set forth in claim 4, further including induced draft fans downstream from said first and second outlets so as to produce a negative pressure to draw particles through said separation chamber and said recovering means.

6. A method for separating electrostatically charged particles, comprising:

triboelectrically charging particles to be separated by promoting particle-particle and particle-sidewall contact;

delivering said triboelectrically charged particles to a separation chamber including a positive electrode for attracting negatively charged particles and a negative electrode for attracting positively charged particles; and generating a flow of curtain gas initially devoid of particles along said electrodes so as to direct said positively and negatively charged particles drawn under the influence of an electric field along an undisturbed deflection path toward said electrodes without remixing to separate recovery outlets.

7. The method set forth in claim 6, including matching flow velocity of said curtain gas with flow velocity of said driving fluid.

8. The method set forth in claim 7, including passing said curtain gas past flow straighteners so as to eliminate eddy currents and provide smooth, straight flow.

9. A tiboelectrostatic separation apparatus, comprising:

a pneumatic eductor wherein particles to be separated are accelerated by a driving fluid;

a separator including an inlet for receiving electrically charged particles to be separated, a separation chamber, a first electrode for attracting negatively charged particles, a second electrode for attracting positively charged particles, a first outlet for discharging negatively charged particles electrostatically drawn toward said first electrode and a second outlet for discharging positively charged particles electrostatically drawn toward said second electrode;

a feed line providing fluid communication between said pneumatic eductor and said inlet to said separator, said particles being triboelectrically charged in said feed line by promoting particle-particle and particle-sidewall contact prior to entering said separator;

a variable voltage source for applying a positive voltage potential to said first electrode and a negative voltage potential to said second electrode; and a curtain gas flow generator for generating a flow of curtain gas initially devoid of particles along said first and second electrodes in said separation chamber, said flow of curtain gas carrying charged particles electrostatically drawn under the influence of an electric field along an undisturbed deflection path toward said first and second electrodes without remixing respectively to said first and second outlets for recovery.

* * * * *